US009907419B1

(12) United States Patent
Mun

(10) Patent No.: US 9,907,419 B1
(45) Date of Patent: Mar. 6, 2018

(54) CONVERTIBLE REVERSIBLE EASY FOLD FITTED BED SHEET

(71) Applicant: Yong C. Mun, Henderson, NV (US)

(72) Inventor: Yong C. Mun, Henderson, NV (US)

( * ) Notice: Subject to any disclaimer, the term of this patent is extended or adjusted under 35 U.S.C. 154(b) by 0 days.

(21) Appl. No.: 15/398,477

(22) Filed: Jan. 4, 2017

Related U.S. Application Data

(63) Continuation of application No. 14/704,243, filed on May 5, 2015.

(51) Int. Cl.
*A47G 9/04* (2006.01)
*A47G 9/02* (2006.01)
*D05B 3/12* (2006.01)

(52) U.S. Cl.
CPC ..... *A47G 9/04* (2013.01); *A47G 9/0246* (2013.01); *D05B 3/12* (2013.01)

(58) Field of Classification Search
CPC ..... A47G 9/04; A47G 9/0426
USPC ..... 5/496, 497
See application file for complete search history.

(56) References Cited

U.S. PATENT DOCUMENTS 2,598,141 A 5/1952 Simpson
2,682,062 A * 6/1954 Cogan ..... A47G 9/0246 5/496
2,757,389 A * 8/1956 King ..... A47G 9/0246 5/496
3,083,379 A 4/1963 Morinsky
3,243,827 A 4/1966 Kintner
3,694,832 A 10/1972 Jamison
4,045,832 A * 9/1977 DiForti ..... A47C 21/022 5/496
4,095,300 A 6/1978 Rattner
4,144,602 A 3/1979 Fernandes
4,344,196 A 8/1982 Large
4,651,371 A * 3/1987 Hahn ..... A47G 9/0246 5/490
5,165,128 A 11/1992 Honig
5,279,009 A * 1/1994 Putka, Jr. ..... A47G 9/0238 5/485
5,491,853 A * 2/1996 Turnbull ..... A47G 9/0246 5/497
6,253,398 B1 7/2001 Yim
6,983,500 B2 1/2006 Wootten
8,011,038 B2 * 9/2011 Balasundharam ... A47G 9/0238 5/482
8,015,636 B2 * 9/2011 Bolish ..... A47G 9/02 5/496
8,393,025 B2 3/2013 Crispino
8,689,373 B2 4/2014 Caines
D708,869 S * 7/2014 Mun ..... D6/602
D714,077 S * 9/2014 Mun ..... D6/602
D715,582 S * 10/2014 Mun ..... D6/602
9,510,698 B1 * 12/2016 Krotova ..... A47G 9/02
2005/0071923 A1 9/2005 Griffin
(Continued)

FOREIGN PATENT DOCUMENTS

FR 2656999 A1 7/1991

*Primary Examiner* — Joshua T Kennedy

(57) ABSTRACT

This invention is a fitted bed sheet that converts to a completely flat bed sheet by releasing the elastic and zippers placed on each corner. This allows this bed sheet to be easily folded like a flat sheet and easy to store. This bed sheet is designed to be reversible and convertible—one side creates a more traditional look and the other has a more ornamental design.

8 Claims, 13 Drawing Sheets

(56) References Cited

U.S. PATENT DOCUMENTS

| | | | | |
|---|---|---|---|---|
| 2008/0028522 | A1 | 2/2008 | Atwood | |
| 2008/0263768 | A1* | 10/2008 | Balasundharam ... | A47G 9/0246 5/497 |
| 2009/0172881 | A1 | 2/2009 | Peterson | |
| 2015/0026887 | A1* | 1/2015 | Taylor ..... | A47G 9/0246 5/496 |
| 2016/0081497 | A1* | 3/2016 | Keinigs ..... | A44B 19/34 5/496 |

* cited by examiner a. Flat/Fitted Sheet -Side 1

Front b. Flat Sheet - Side 1 c. Flat/Fitted Sheet - Side 2

Back d. Flat Sheet - Side 2

Back

Front - Fitted Sheet

Ref. Fig. 1

Front Flat Sheet

Ref. Fig. 2

Back Fitted Sheet

Ref. Fig. 3

Front/Flat Sheet

Ref. Fig. 4

FIG. 13A
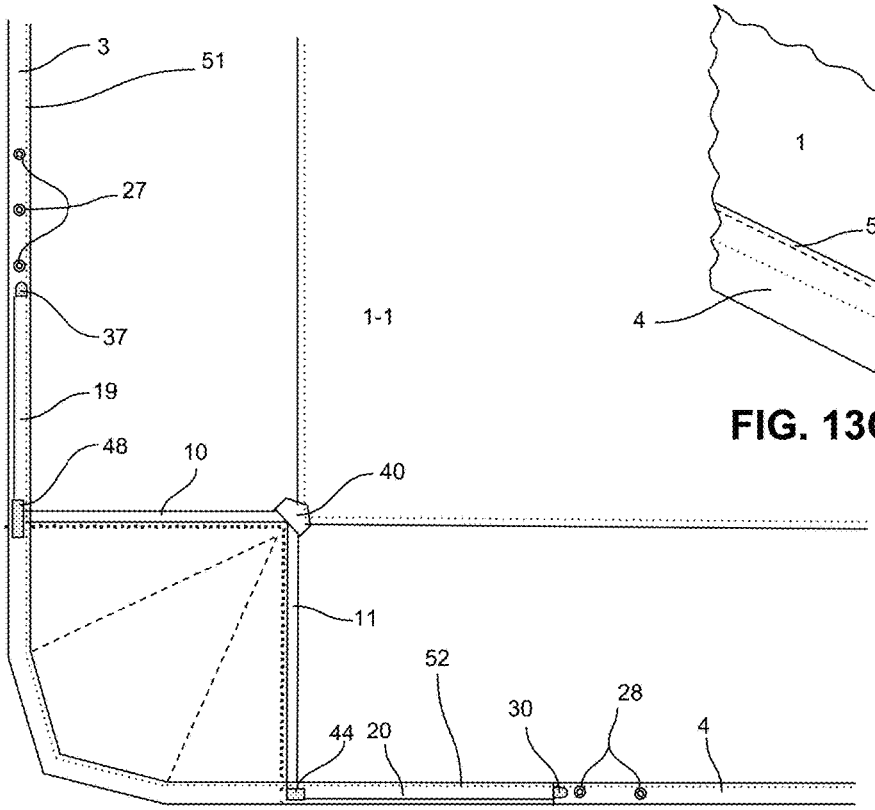
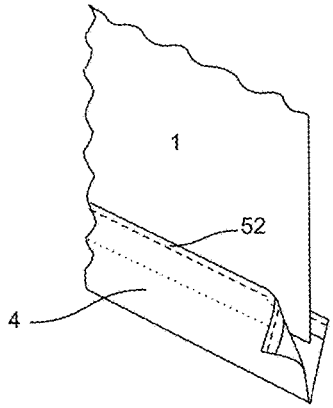
FIG. 13C
FIG. 13B
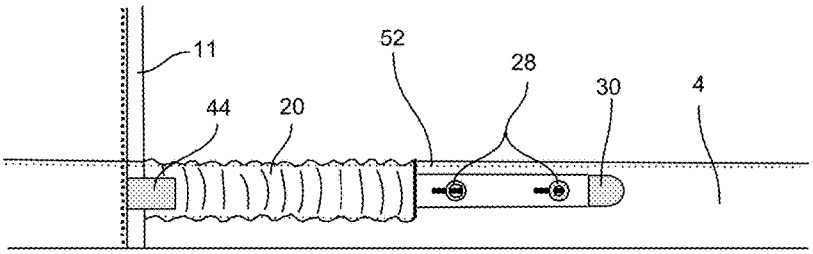

CONVERTIBLE REVERSIBLE EASY FOLD FITTED BED SHEET

RELATED PATENT

U.S. D708,869 S—Date of Patent: Jul. 15, 2014, Filed: Mar. 25, 2014

U.S. D714,077 S—Date of Patent: Sep. 30, 2014, Filed: Jun. 4, 2014

U.S. D715,582 S—Date of Patent: Oct. 21, 2014, Filed: Jun. 4, 2014

BACKGROUND OF INVENTION

Conventional fitted bed sheets are not easy to fold and store, especially, bigger sized sheets such as queen and king sheets. The purpose of this invention is so that bed sheets can be easily folded after being washed and dried to store. The design of this sheet allows the sheet to be convertible from a flat sheet to a fitted sheet and is also reversible which creates an ornamental design—all by releasing zippers, buttons, elastics or other similar mechanism for the same purpose. There are no other products on the market that have this kind of complete multi function bed sheet for fitted or flat sheets.

BRIEF SUMMARY OF THE INVENTION

This invention is a bed sheet that is convertible and reversible from a flat bed sheet into a fitted bed sheet or vice versa. This design provides four different benefits. First, it is much easier to fold and store than traditional fitted sheets. Second, it has an option to make a bed without having the bed sheet to tuck in the bottom corners to keep the sheet in place and stay tight on a mattress. There is still the option to use this fitted sheet in a traditional way as well by using the releasable elastics installed onto the corners of the sheet. Third, the bed sheet is reversible and neither side looks inside out which shows a complete natural look of the bed sheet and the ornamental design. Fourth, the corner pieces of the zippered area can be an option to make detachable.

BRIEF DESCRIPTION OF THE DRAWINGS

FIG. 13B. Elastic was pulled and secured by buttoning up the buttons (side 1).

FIG. 13C. View of the expansion of the edges

FIG. 1: Main bed sheet; 1 has an added center sheet on the front sheet; 1-1, optional, Expansion of the edges of the bed sheet; 2,3,4 and 5. The width can be modified depending on personal preferences. Opened zippers; 6, 7, 8, 9, 10, 11, 12 and 13. Separate fabrics can be sewn over the edges (FIG. 15) with desirable lengths starting from the zipper (recommend 12 to 24 inches); 14, 15, 16, 17, 18, 19, 20 and 21. The elastic can be inserted between the expanded edges before being sewn over the elastic onto the expanded edges (FIG. 13, FIG. 14). The beginning of the inserted elastic can be attached between the two elements and leave the rest of the elastic loose in order to fasten or release; 22, 23, 24, 25, 26, 27, 28 and 29. Buttons can be sewn onto the other end of the elastic to be fastened or released to make the fitted bed sheet or to make it easy to fold it to store. These buttons be can be replaced with other types of mechanisms to fasten and release elastics such as velcro, hooks, different types of snap buttons; 30,31,32,33,34,35,36 and 37. The end piece of the elastic is used a pull to fasten or to make the fitted bed sheet; 38, 39, 40 and 41. Pieces of the fabric are used to cover the top of the zipper to protect it from being damaged by washing and drying and hiding the zipper cap and puller; 42,43,44 and 45. A piece of velcro has been attached to the opposite side of the velcro to connect to 46,47,48 and 49 securely. The zippers stay on and hide the zipper cap and puller. This velcro can be replaced by other mechanisms such as hooks, buttons or any type of snap buttons. Pieces of 46,47,48 and 49 can be connected to 42,43,44 and 45 on the opposite side of the velcro 50,51,52 and 53. Stitches connecting the expansion fabric to the main bed sheet 54,55.56 and 57 and the other side of the zippers 58,59,60 and 61. Additional pieces of the fabric on the bottom two corners help stabilize the shape of the loose fabric help with the ornamental design look. The large flat bed sheet can be folded in half easily in either direction utilizing an interlocking system with the connector 44*a* to 49*a* and 47*a* to 42*a*, or 44*a* to 47*a* and 49*a* to 42*a* to secure both touching side stays together.

DETAILED DESCRIPTION OF THE INVENTION

Figure 1:
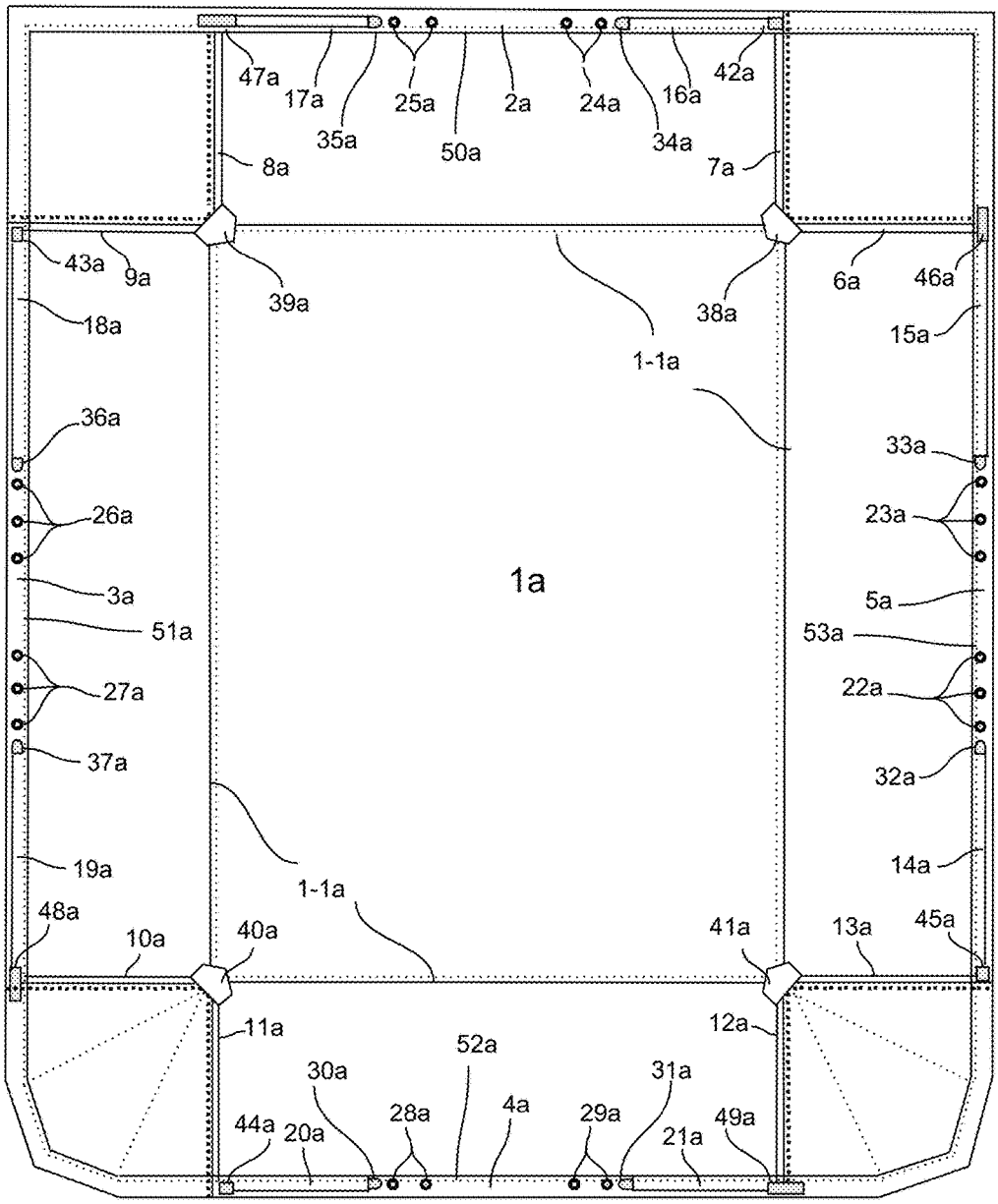
FIG. 1. Front (side 1) flat/fitted bed sheet, Convertible to fitted bed sheet.
Figure 2:
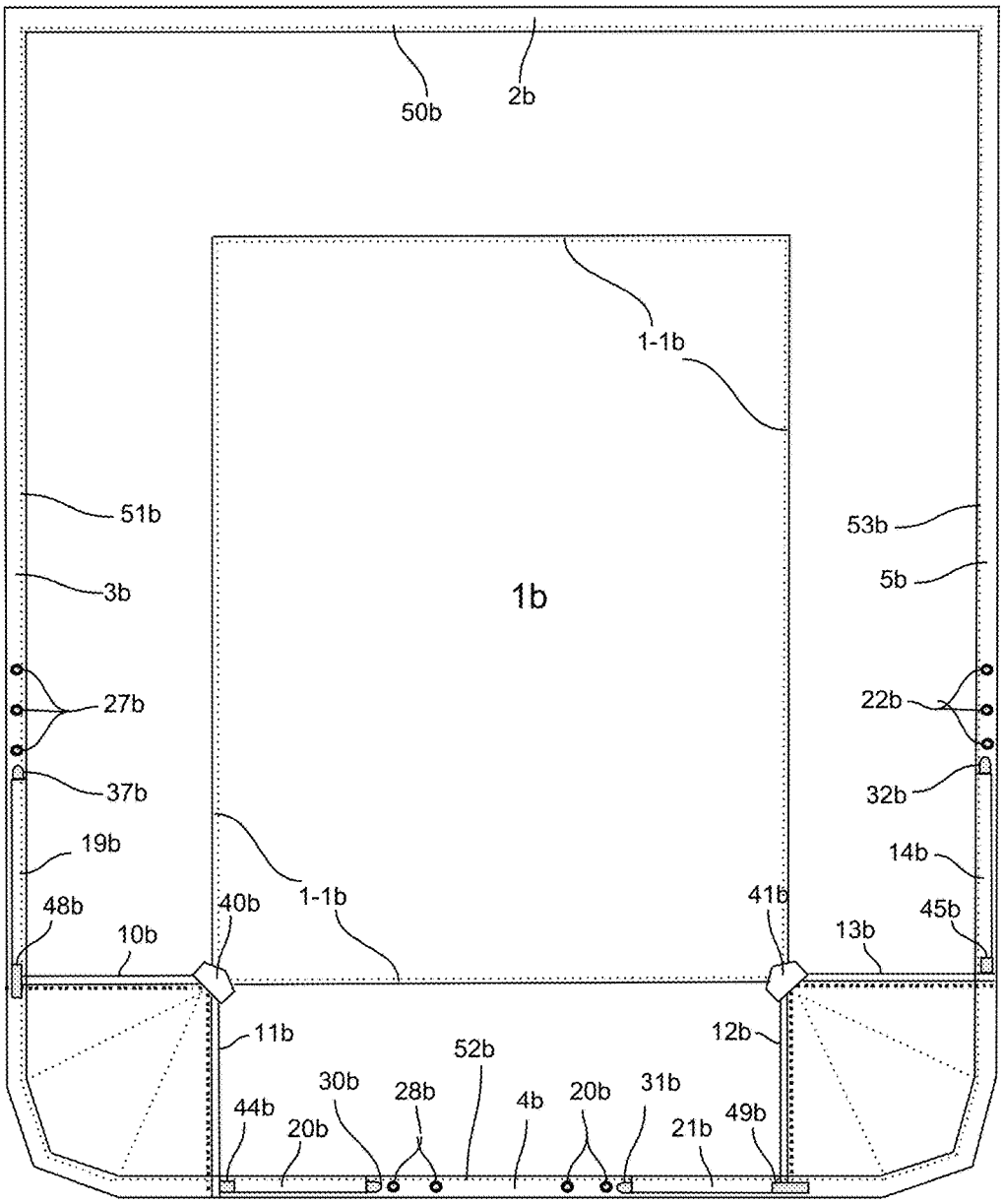
FIG. 2. Front (side 1) flat bed sheet.
Figure 3:
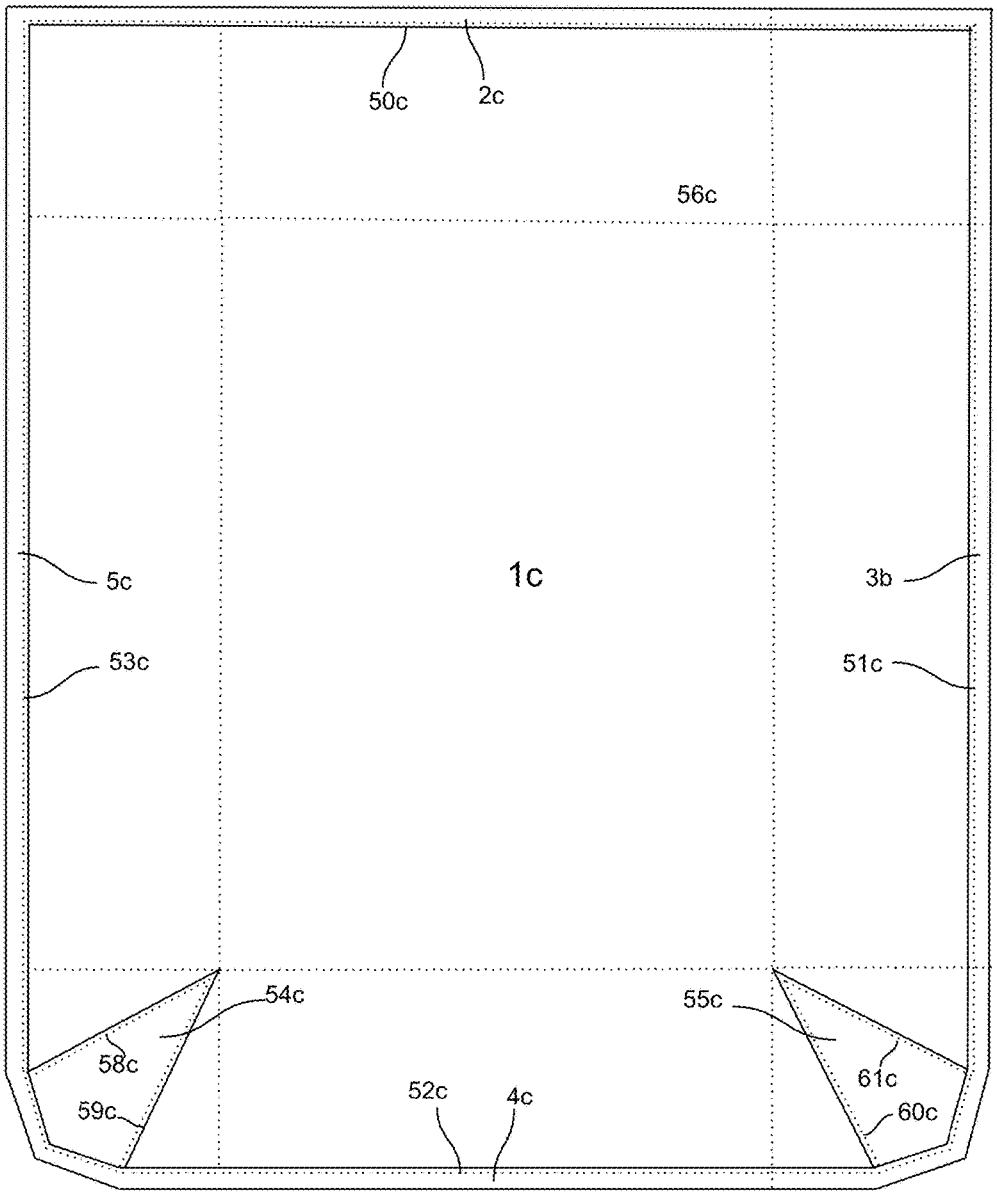
FIG. 3. Back (side 2) flat/fitted bed sheet. Convertible to fitted bed sheet FIG. 4. Back (side 2) Flat bed sheet FIG. 5A. Overall view of the front (side 1) fitted bed sheet, FIG. 1
Figure 4:
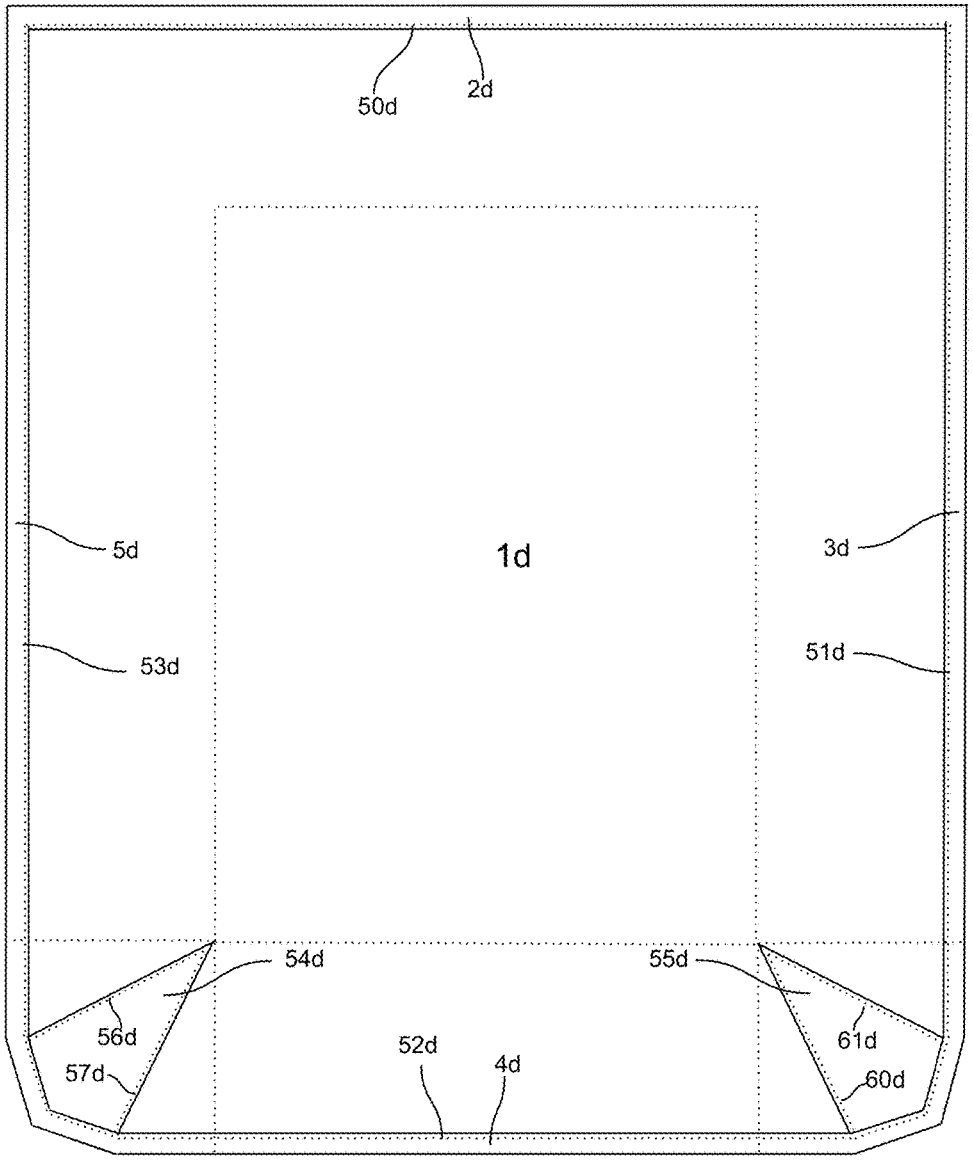
Figures 5A, 5B:
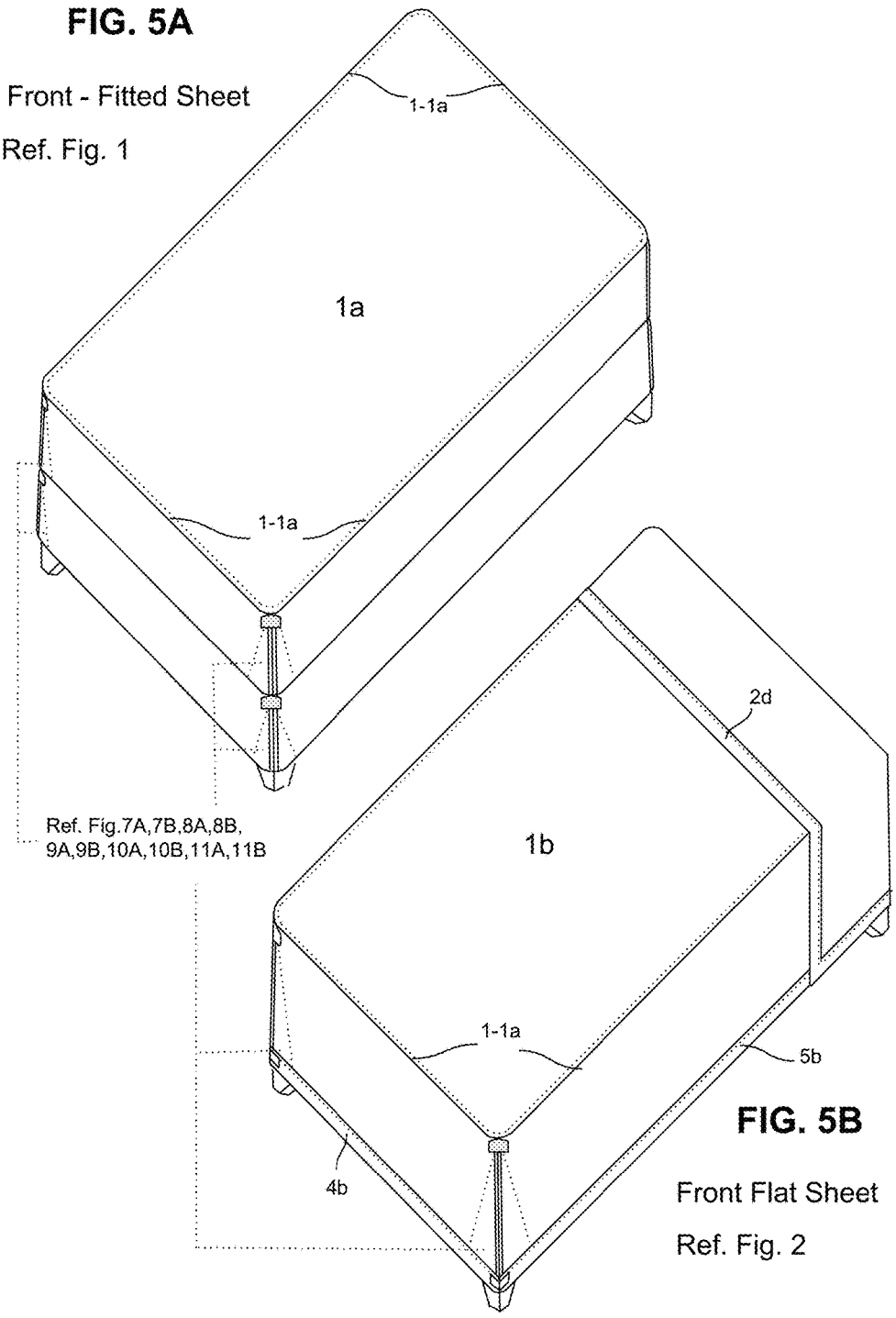
FIG. 5B. Overall view of the front (side 1) flat bed sheet, FIG. 2
Figures 6A, 6B:
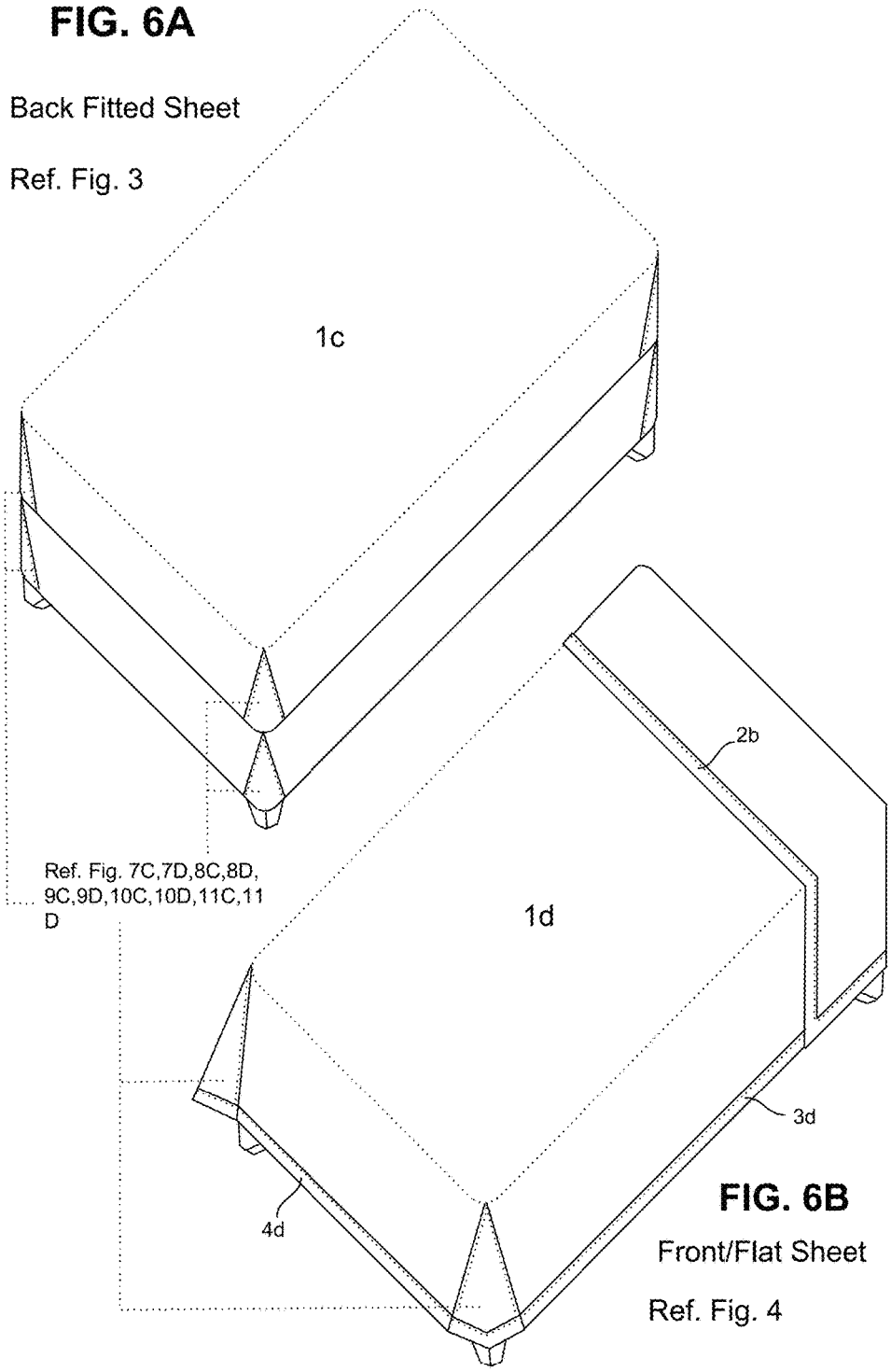
FIG. 6A. Overall view of the back (side 2) fitted bed sheet, FIG. 3
FIG. 6B. Overall view of the back (side 2) flat bed sheet, FIG. 4
Figure 7A:
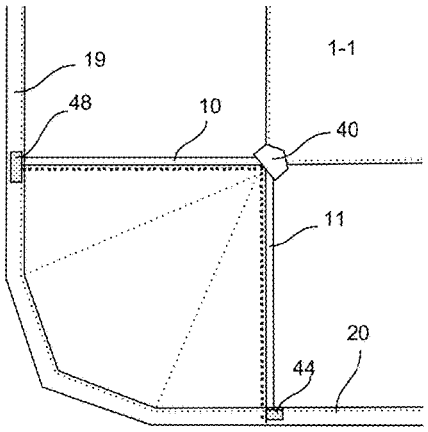
FIG. 7A. Open zipper on the front side (side 1) slightly cut corners
Figure 7C:
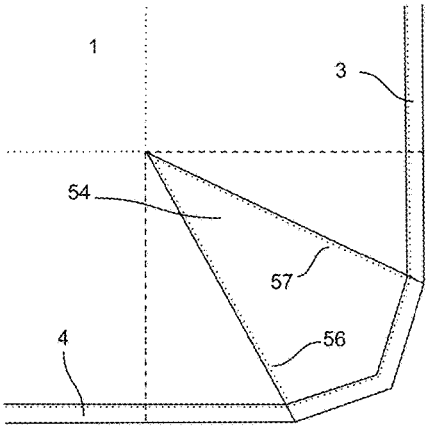
FIG. 7C. Open zipper on the back side (side 2) slightly cut corners
Figure 7B:
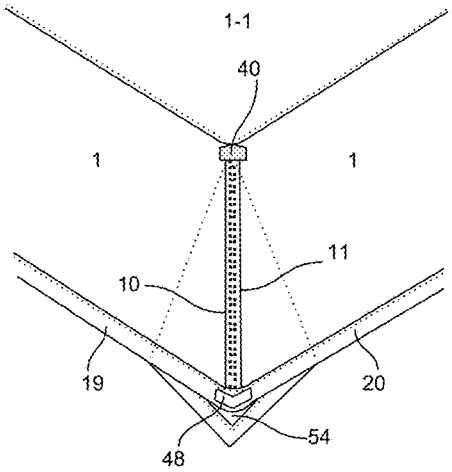
FIG. 7B. Closed zipper on the front side (side 1) slightly cut corners
Figure 7D:
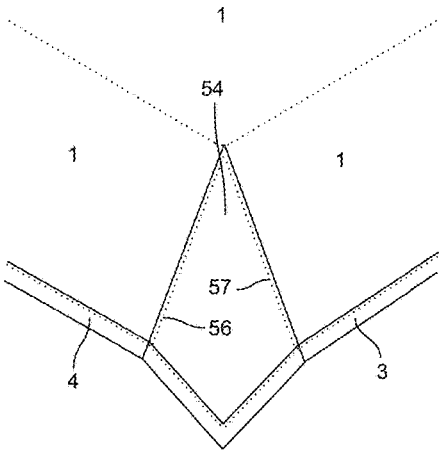
FIG. 7D Closed zipper on the back side (side 2) slightly cut corners
Figure 8A:
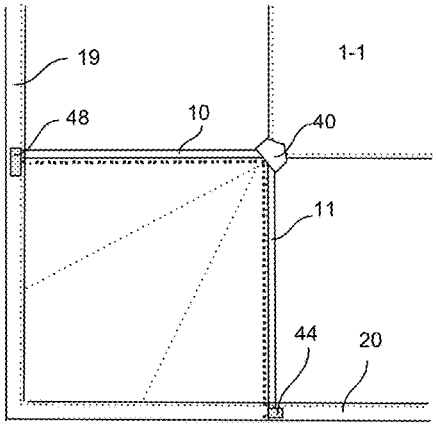
FIG. 8A. Open zipper on the front side (side 1) full length of the corners
Figure 8C:
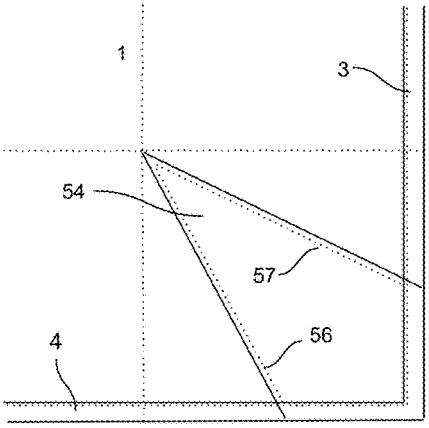
FIG. 8B. Closed zipper on the front side (side 1) full length of the corners FIG. 8C. Open zipper on the back side (side 2) full length of the corners FIG. 8D. Closed zipper on the back side (side 2) full length of the corners.
Figure 8B:
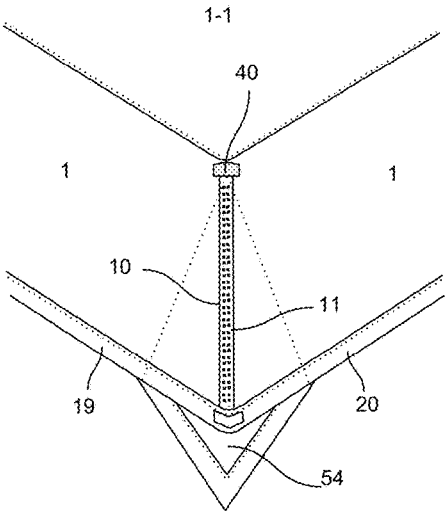
Figure 8D:
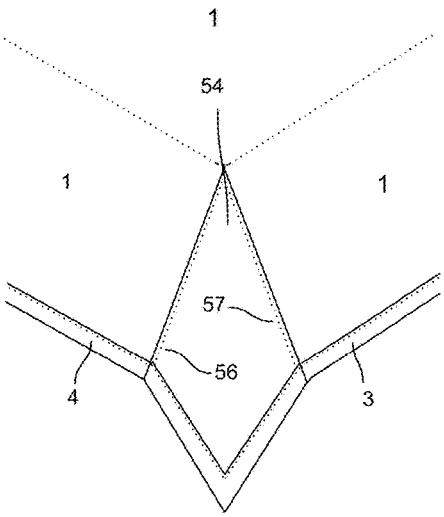
Figure 9A:
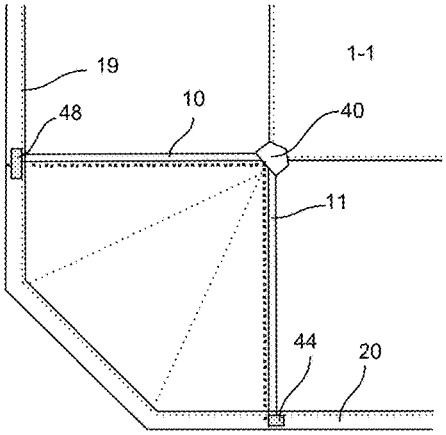
FIG. 9A. Open zipper on the front side (side 1) shorter cut corners
Figure 9C:
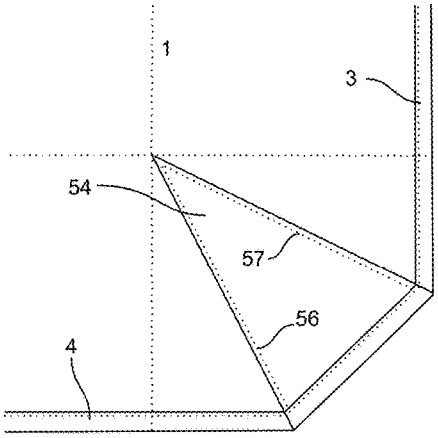
FIG. 9C. Open zipper on the back side (side 2) shorter cut corners
Figure 9B:
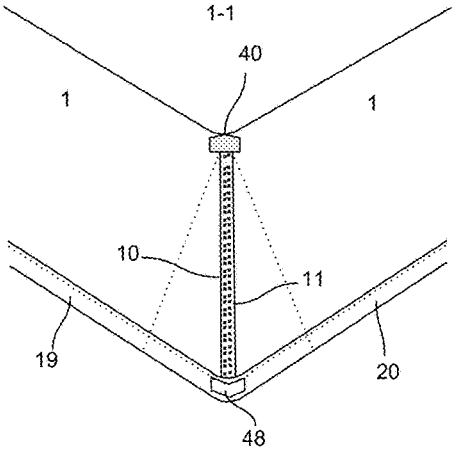
FIG. 9B. Closed zipper on the front side (side 1) shorter cut corners
Figure 9D:
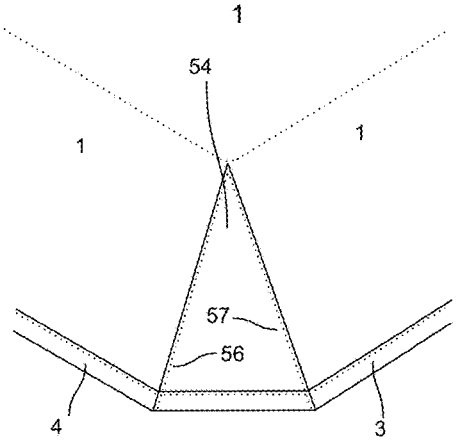
FIG. 9D Closed zipper on the back side (side 2) shorter cut corners
Figure 10A:
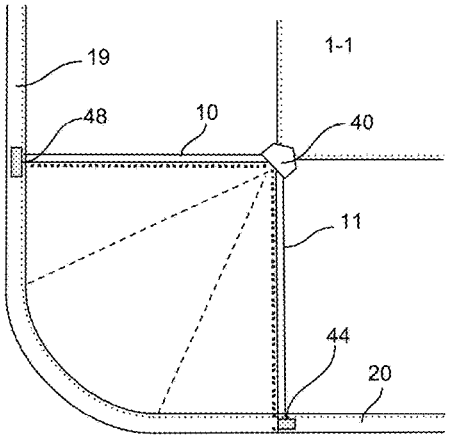
FIG. 10A. Open zipper on the front side (side 1) round cut corners
Figure 10C:
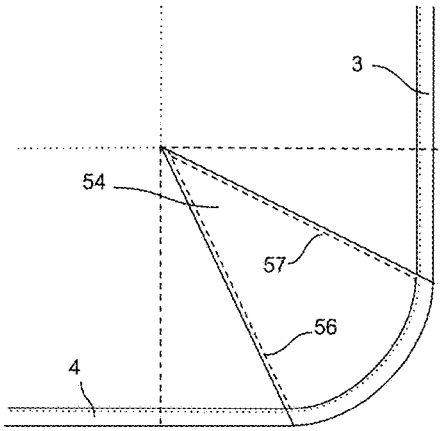
FIG. 10C. Open zipper on the back side (side 2) round cut corners
Figure 10B:
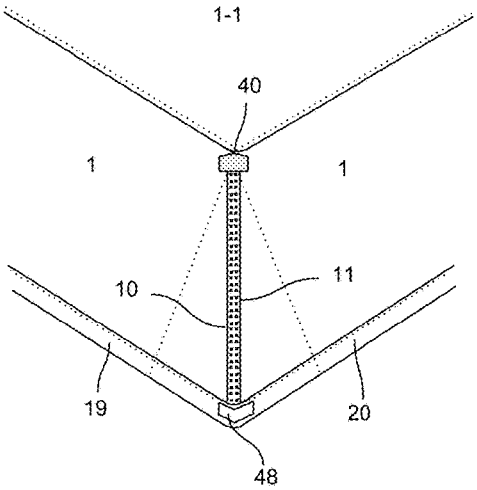
FIG. 10B. Closed zipper on the front side (side 1) round cut corners
Figure 10D:
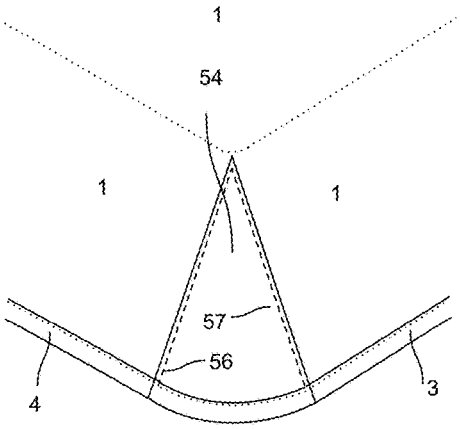
FIG. 10D Closed zipper on the back side (side 2) round cut corners
Figure 11A:
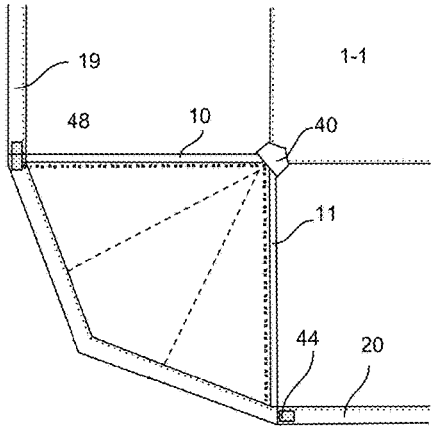
FIG. 11A. Open zipper on the front side (side 1) shorter center corners cut
Figure 11C:
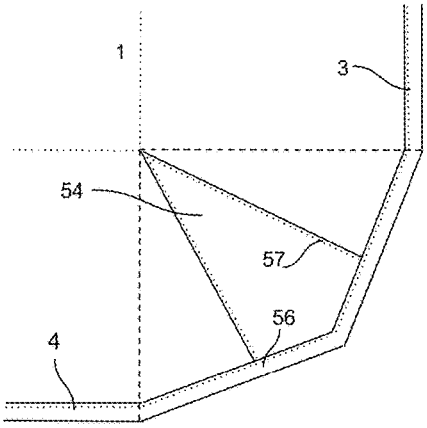
FIG. 11B. Closed zipper on the front side (side 1) shorter center corner cut FIG. 11C. Open zipper on the back side (side 2) shorter center corner cut FIG. 11D. Closed zipper on back side (side 2) shorter center corner cut FIG. 12A. Detachable corner area FIG. 13A. Enlarged corner area (FIG. 1, bottom right corner)
Figure 11B:
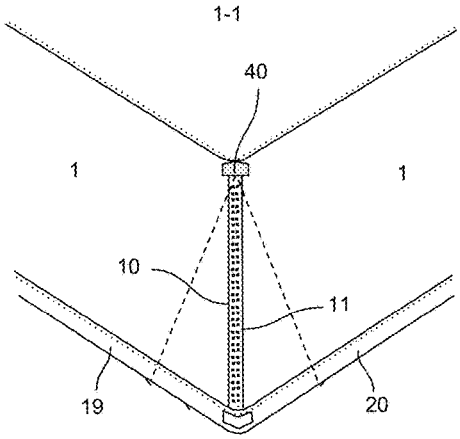
Figure 11D:
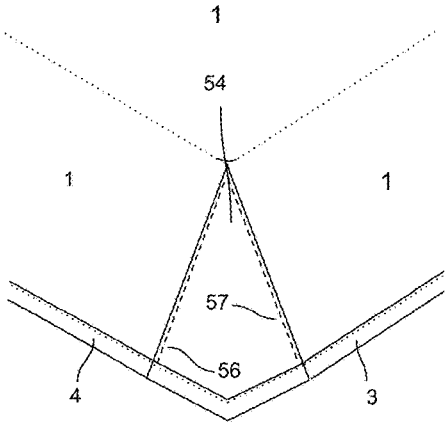
Figure 12A:
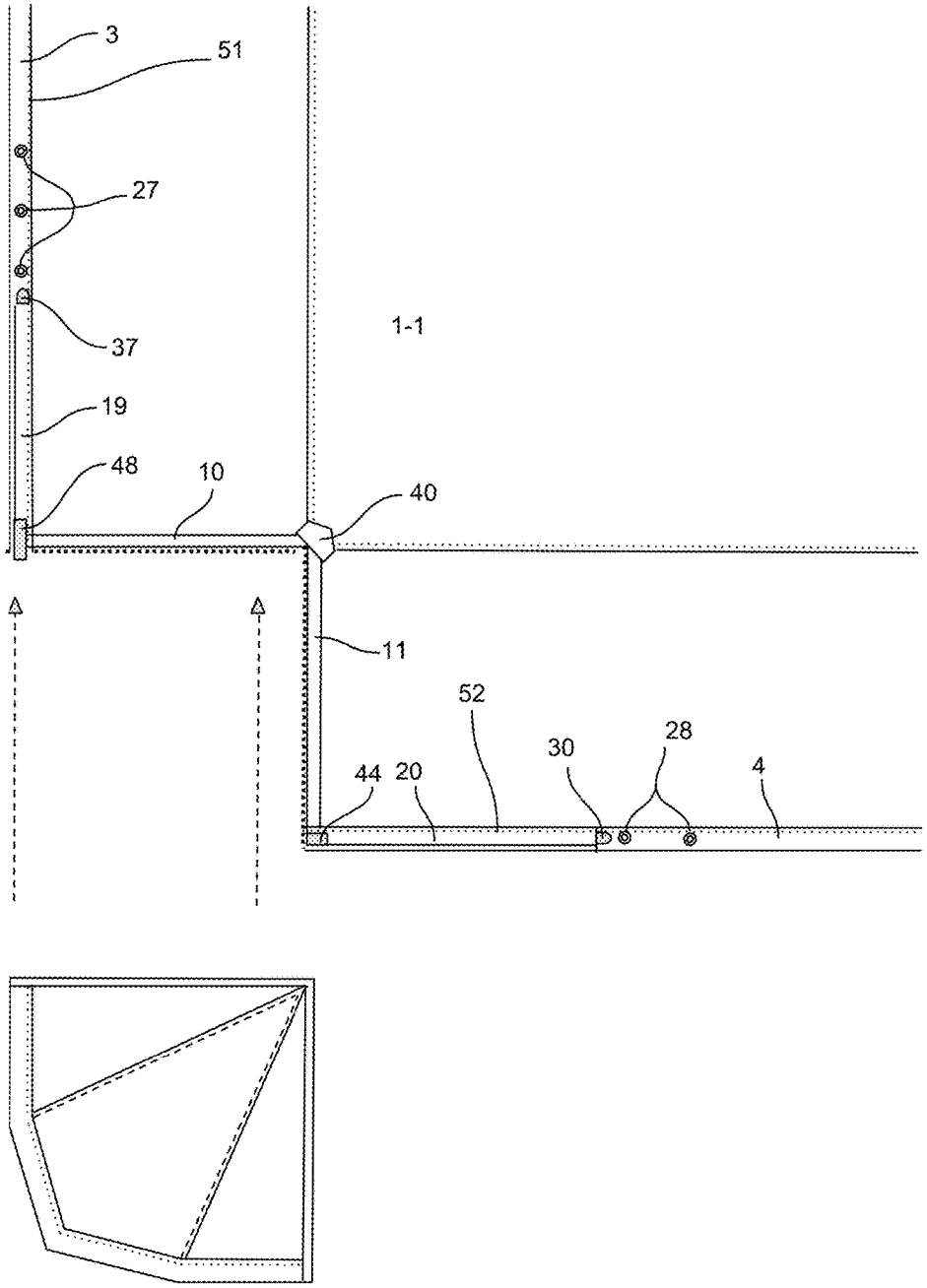

This bed sheet is designed to resolve the problems with folding fitted bed sheets, to make the bed easier and make it comfortable when you sleep. The entire flat bed sheet remains intact with zippers sewn at 90 degrees facing the corners of the fabric and using releasable elastics that are attached onto the expansion area next to the zippers. The edges of each corner must be cut shorter to avoid touching the floor with different shapes or can be left without cutting depending on personal preferences. This method can be done with the bottom two corners only or all four corners. The zipper can be replaced by any alternative method such as buttons, hooks, velcro, snap buttons, or any other locking and attachment methods. The attached releasable elastics are optional to use to make it fit under the mattress to make the bed sheet tight to the mattress or leave them loose for an ornamental design and easier method making the bed. A method of pulling upward the bottom two corners of the bed sheet slightly makes a room for feet when sleep.

The expansion of the edges for the attachment of the releasable elastic around the bed sheet gives an additional benefit for an option to choose a different colored fabric with equal width for an ornamental design and to balance the thickness of the edges resulted from the releasable elastic installation. It gives an option to use the design and coordination with colors of other bedding sets such as pillowcases and comforters, etc.

The top of the zippers will be covered with a small piece of fabric, elastic, or other material to cover and protect a zipper pull from possible damage due to washing and drying. The bottom part of the zipper will be covered by putting small releasable pieces of connectors on each side of the zipper such as velcro, button, hooks, snap buttons, or any other attachment method to protect zippers from washing and drying and secure the zipper to stay closed tight. In other words, covering the top of the zipper protects the zipper caps and pullers when the zipper is unzipped and hides the zipper caps and pullers. The method of connecting the bottom two pieces of zippers from each side together locks the bottom area of each corners to stay fit and tight to the mattress when it is in use. The other benefit of the said method is that the connectors can be utilized connecting either opposite side of the connector to fold and lock both touching side during the folding stage.

Additional fabric can be attached diagonally with isosceles triangle shape in the center part between the open zippers on the loose side of the corner on the outer skirt to keep the fabric on the isosceles triangle shape for the ornamental design look.

An additional piece of fabric, the same dimension of the top of the mattress surface, can be sewn onto the center of the back side of the fabric to make it a complete view of the reversible bed sheet which is optional.

This invention is not limited to bed sheets only and this can be utilized for table covers, couch covers, or any other covers.

REFERENCE

1. U.S. Pat. No. 8,015,636 B2
2 FR2656999A1 aka WO 2008120260 A1
3. U.S. Pat. No. 4,095,300 A
4. U.S. Pat. No. 8,689,373 B2
5. U.S. Pat. No. 5,491,853 A
6. US 20090172881 A1
7. U.S. Pat. No. 4,651,371 A
8. US 20050071923 A1
9. U.S. Pat. No. 5,165,128 A
10. U.S. Pat. No. 2,598,141 A
11. U.S. Pat. No. 3,083,379 A
12. U.S. Pat. No. 4,144,602 A
13. U.S. Pat. No. 6,983,500 B2
14. U.S. Pat. No. 3,243,827 A
15. U.S. Pat. No. 6,253,398 B1
16. US 20080028522 A1
17. U.S. Pat. No. 8,393,025 B2
18. U.S. Pat. No. 4,344,196 A
19. U.S. Pat. No. 3,694,832 A The claimed invention is:

1. A convertible reversible fitted bed sheet comprising a flat bed sheet comprising:

a central panel;

two opposing side panels and at least one end panel extending from said central panel, the at least one end panel and the two opposing side panels each having lateral edges, wherein the lateral edges of the at least one end panel form 90 degree angles with corresponding lateral edges of the two opposing side panels at corners of the central panel;

removable corner pieces each having two perpendicular edges attached to the lateral edges of the at least one end panel and each of the two opposing side panels, respectively, with a mechanical fastener system having cooperating fasteners along the length of each of the lateral edges;

releasable elastic pieces anchored adjacent a lower part of each fastener and having a portion for attaching to a corresponding fastening mechanism along an outer edge of each side panel or an outer edge of each said at least one end panel such that when the elastic pieces are stressed and attached to the respective fastening mechanism, the flat bed sheet is adapted to wrap closely around a mattress.

2. The bed sheet of claim 1, further comprising a second end panel opposite the at least one end panel.

3. The bed sheet of claim 1, further comprising a cover over the mechanical fastener system to hide and protect the mechanical fastener from possible damage that might occur by washing and drying and for an ornamental design look; wherein the cover is selected from the group consisting of a piece of fabric, elastic, and lace.

4. The bed sheet of claim 1, further comprising additional fastener pieces on each side of each mechanical fastener system; the additional fastener pieces arranged as a pairs of connectors to help hide and protect both ends of the mechanical fastener system and to prevent the bedsheet from shifting with respect to the mattress.

5. The bed sheet of claim 1, wherein the removable corner pieces comprise fabric sewn in a diagonally isosceles triangle shape in a center part between the two perpendicular edges.

6. The bed sheet of claim 1, further comprising an additional piece of fabric, having a same length and width as a top of the flat bed sheet, sewn onto a center of a back side of the flat bed sheet to make it a complete view of the reversible bed sheet.

7. The bed sheet of claim 1, wherein the mechanical fastener system comprises zippers, buttons, hooks, hook and loop fasteners, and/or snap buttons.

8. The bed sheet of claim 1, further comprising a separate piece of fabric around the edges of the side panels in which the releasable elastic pieces are located.

* * * * *